US005335592A

United States Patent [19]

Röttger

[11] Patent Number: 5,335,592

[45] Date of Patent: Aug. 9, 1994

[54] DEVICE FOR APPLYING PRESSURE TO THE SURFACE OF ADVANCING WORK

[75] Inventor: Rolf Röttger, Melle, Fed. Rep. of Germany

[73] Assignee: Firma Theodor Hymmen, Bielefeld, Fed. Rep. of Germany

[21] Appl. No.: 855,285

[22] Filed: Mar. 23, 1992

[30] Foreign Application Priority Data

Apr. 5, 1991 [DE] Fed. Rep. of Germany ..... 4111022

[51] Int. Cl.[5] ..... B30B 5/04

[52] U.S. Cl. ..... 100/151; 277/227

[58] Field of Search ..... 100/151, 93 RP, 93 P, 100/154; 222/DIG. 7, 72 FM, 227

[56] References Cited

U.S. PATENT DOCUMENTS 3,620,158 11/1971 Terelli et al. ..... 100/154
4,331,073 5/1982 Girola ..... 100/154
4,341,889 9/1985 Held ..... 100/93 RP
4,537,408 8/1985 Pankoke ..... 277/34
4,632,722 12/1986 Pankoke ..... 100/93 RP
4,665,818 5/1987 Held ..... 100/93 RP
4,711,168 12/1987 Held ..... 100/93 RP

*Primary Examiner*—Timothy F. Simone
*Assistant Examiner*—Reginald L. Alexander
*Attorney, Agent, or Firm*—Sprung Horn Kramer & Woods

[57] ABSTRACT

A device for applying pressure to the surface of an advancing workpiece has at least one continuous belt forced against the belt by fluid introduced into an inflatable pad demarcated by part of one of the pressure-application belt's strands, on the side facing the strand by a rectangular slab, and at the longitudinal and transverse edges of the slab in terms of the direction the belt travels in by a sealing strip of plastic or similar material at the edge of the slab and resting against the belt. Such sealing strips are exposed to high pressures and temperatures. To increase their life, solid shapes of a solid lubricant are accordingly embedded at intervals in the sealing strip with an active surface exposed against the associated strand of the belt.

6 Claims, 2 Drawing Sheets

DEVICE FOR APPLYING PRESSURE TO THE SURFACE OF ADVANCING WORK

BACKGROUND OF THE INVENTION

The invention concerns a device for applying pressure to the surface of such an advancing workpiece as plywood for example, against which at least one continuous belt is forced by fluid introduced into an inflatable pad demarcated by part of one of the pressure-application belt's strands, on the side facing the strand by a rectangular slab, and at the longitudinal and transverse edges of the slab in terms of the direction the belt travels in by a sealing strip of plastic or similar material at the edge of the slab and resting against the belt.

A device of this type is known (from German Patent 3 313 406). The strip is fastened to a rectangular frame. The frame is secured in a groove in the slab, moves in and out of the groove and is forced toward the belt. The belt travels along the strip.

The strips and belts in two-belt presses that employ fluid-inflated pads seal the pad off from the atmosphere. The belts are steel.

Such presses operate continuously, and the strips must satisfy high demands to ensure that the pad is reliably sealed no matter what state the press is in. The belt travels at a wide range of speeds, and the friction between it and the strip must be low no matter how rapidly it is traveling. The strip must also be resistant to heat over a wide range of temperatures. Finally, the strip must be long-lasting.

Such strips are made out of slippery and heat-resistant plastics.

In order to comply even more satisfactorily with the aforesaid demands, distributing nozzles or channels along the strip to deliver lubricant directly to the seal interface is known (European Patent B 0 166 886).

Sealing strips thus lubricated operate satisfactorily up to moderate pressures. At higher pressures, however, the film of lubricant is forced out of the interface too rapidly. Another drawback is the rather high price per kilogram of the special-purpose oils required.

Also known are self-lubricating low-friction components in the form of sleeves and plates made of solid lubricants in a metal matrix. Such components, however, are inappropriate for sealing off pads in belt presses. Subject to the high pressure and heat that occurs, metal particles are hurled out, especially at low belt speeds, and lead to fretting and freezing and hence to damage to the sensitive surface of the steel belt.

SUMMARY OF THE INVENTION

The object of the present invention is to improve the highly stressed sliding-contact seals in a device of the aforesaid genus to the extent that they will satisfy the aforesaid demands more effectively and that operations can be carried out at wider ranges of pressure, temperature, and belt speeds.

This object is attained in accordance with the invention in that solid shapes of a solid lubricant are embedded at intervals in the plastic sealing strip with an active surface exposed against the associated strand of the belt.

The permanently embedded solid-lubricant shapes wear down at the same rate as the sealing strip itself.

It has surprisingly been discovered that the occasional sintering of "small" particles of solid lubricant into the plastic that a seal is made of can extensively decrease the life of the strip, whereas relatively large embedded shapes of solid lubricant will decrease wear and increase life.

The shapes of solid lubricant in one advantageous embodiment can be embedded in the plastic sealing strip to the depth that it is exposed to wear.

The life of the seal around the pad can also be extended even if the shapes of solid lubricant are embedded only in the sealing strips that parallel the direction the belt is traveling in.

Further characteristics of the invention will be evident from the subsidiary claims.

Embodiments of the invention will now be specified by way of example with reference to the drawing.

DESCRIPTION OF PREFERRED EMBODIMENT

Figure 1A:
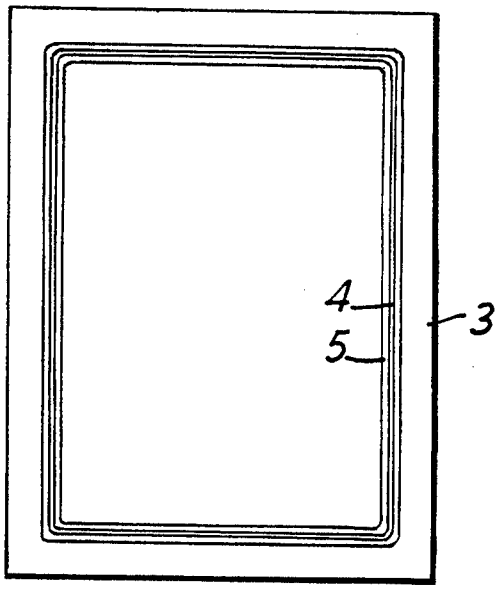
FIG. 1*a* is a view from a belt of a pressure pad.
Figure 1B:
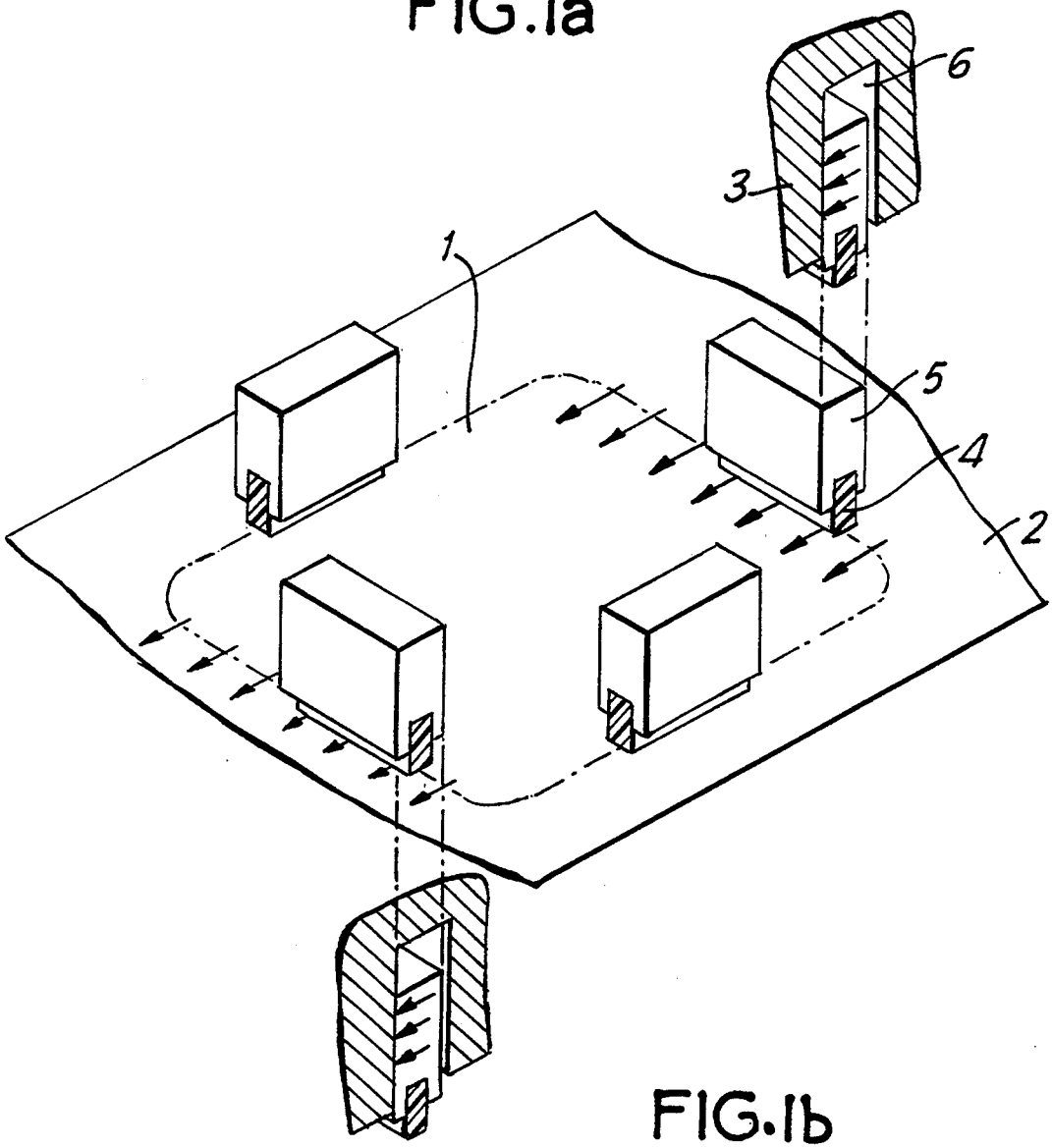
FIG. 1*b* is a schematic perspective view of a pad and the associated pressure-application belt.

The outer contour of a pressure chamber 1 is represented in FIG. 1*b* by a dot-and-dash line. Chamber 1 is demarcated on one side by the active belt of a continuous steel pressure-application belt, on the facing side by a pressure-application slab 3, and all around by a sealing strip 4 made of plastic or similar material.

The sealing strip 4 in the illustrated embodiment is secured to a rectangular frame 5 as illustrated in part by the dot-and-dash line in FIG. 1*b* and in FIG. 1*a*. Frame 5 engages a matching groove 6 in slab 3 and is forced against belt 2 by hydraulic or pneumatic fluid, securing strip 4 by friction against the belt.

Shapes 7 of solid lubricant are permanently embedded in strip 4 with the active surface 8 that faces the belt exposed and resting against the active surface 9 of the sealing strip.

Figure 2:
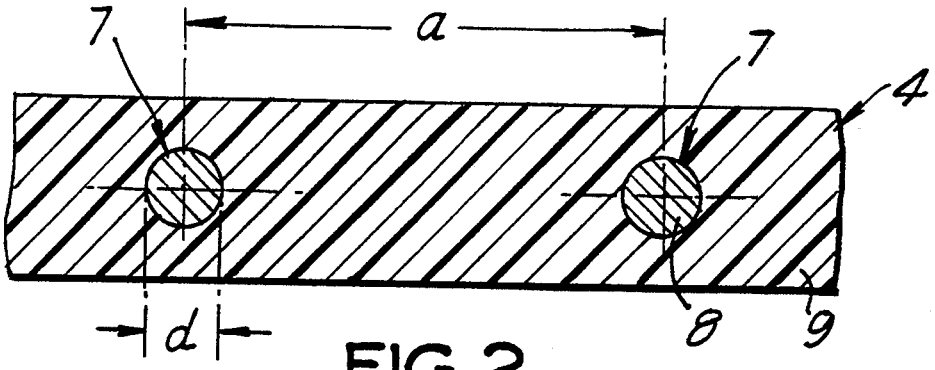
FIGS. 2 through 5 illustrate various shapes of solid lubricant in various positions.

The shapes 7 in the embodiment illustrated by way of example in FIG. 2 are pins distributed along the plane through the middle of strip 4.

Figure 3:
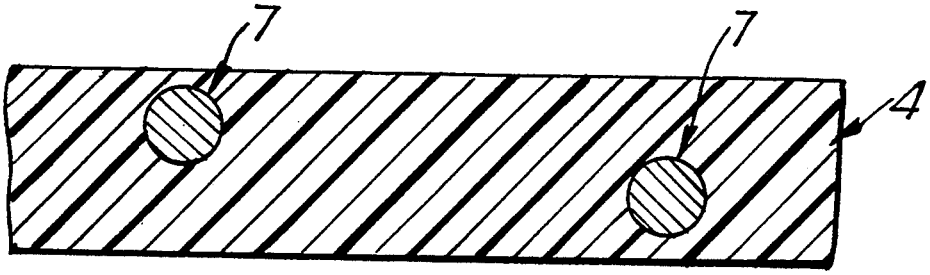

The shapes 7 in the embodiment illustrated in FIG. 3 are to one side of the plane through the middle of strip 4.

Figure 4:
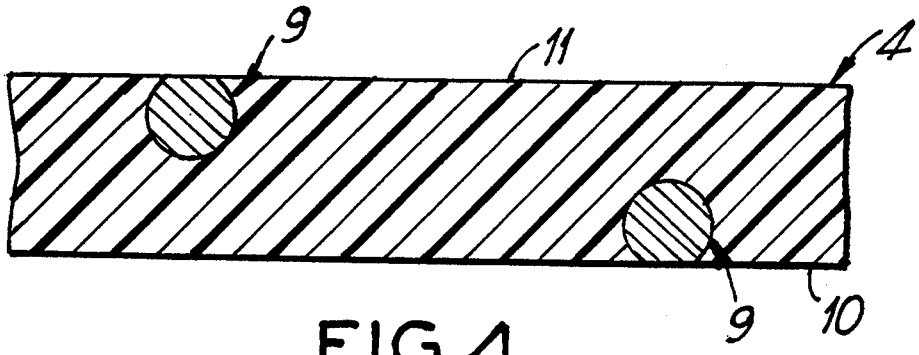

The shapes 9 in the embodiment illustrated in FIG. 4 rest not only against the active surface facing the belt but also against one lateral surface 10 or 11 of strip 4.

The distance a between two adjacent shapes is at least twice the diameter d or greatest thickness of the shape.

Figure 5:
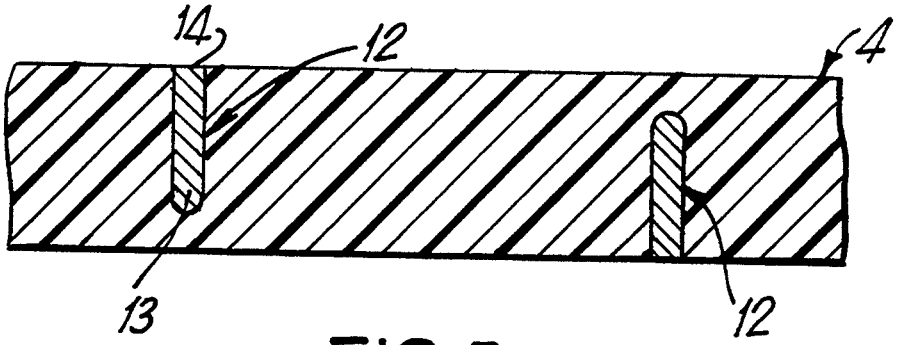

The shapes 12 in the embodiment illustrated by way of example in FIG. 5 are strips and extend with their active surface 13 exposed against the belt and one side of strip 4.

The cross-sections of the shape can also differ from those illustrated in the figures. They can be pins, plugs, blebs, strips or polygonal blocks.

The solid lubricant can be polytetrafluorethylene, graphite, molybdenum disulfide, or a combination thereof.

What is claimed is:

1. A device for applying pressure to a surface of a workpiece, comprising: at least one continuous belt movable in a direction of travel and having one surface for contacting one surface of a workpiece and means forming a pressure chamber with the at least one continuous belt to apply pressure to said one surface of the workpiece comprising a body and a frame slidably mounted in the body for movement towards the at least one continuous belt to close the chamber and having a plastic sealing strip at one end facing the at least one continuous belt, wherein the sealing strip has one surface facing the at least one continuous belt for contacting the at least one continuous belt when the chamber is closed and pieces of solid lubricant embedded in the sealing strip and having shapes selected from the group consisting of pins, plugs, blebs, strips and polygonal blocks and having an exposed active surface facing the at least one continuous belt and constituting a portion of the one surface of the sealing strip, the exposed active surface contacting the at least one continuous belt when the chamber is closed.

2. The device as in claim 1, wherein the pieces of solid lubricant are embedded in the sealing strip to a depth that the sealing strip is exposed to wear.

3. The device as in claim 1, wherein the pieces of solid lubricant are embedded only in portions the sealing strip that parallel the direction of travel of the belt.

4. The device as in claim 1, wherein the pieces are distributed one of along and to one side of a middle plane of the sealing strip.

5. The device as in claim 1, wherein the pieces are flush with the active surface facing the at least one continuous belt and a lateral surface of the sealing strip. polygonal blocks.

6. The device as in claim 1, wherein the solid lubricant is selected from the group consisting of polytetrafluorethylene, graphite, molybdenum disulfide, and combinations thereof.

* * * * *